US007800306B2

(12) United States Patent
Oh

(10) Patent No.: US 7,800,306 B2
(45) Date of Patent: Sep. 21, 2010

(54) PLASMA DISPLAY PANEL HAVING VARYING DISTANCE BETWEEN ELECTRODE PAIRS

(75) Inventor: Jaeyoung Oh, Daegu (KR)

(73) Assignee: LG Electronics Inc., Seoul (KR)

( * ) Notice: Subject to any disclaimer, the term of this patent is extended or adjusted under 35 U.S.C. 154(b) by 518 days.

(21) Appl. No.: 11/338,825

(22) Filed: Jan. 25, 2006

(65) Prior Publication Data

US 2006/0170356 A1 Aug. 3, 2006

(30) Foreign Application Priority Data

Feb. 1, 2005 (KR) ..... 10-2005-0009282

(51) Int. Cl.
*H01J 17/49* (2006.01)
*G09G 3/29* (2006.01)
*H01J 9/00* (2006.01)

(52) U.S. Cl. ..... 313/585; 313/581; 313/587; 315/169.1; 345/60

(58) Field of Classification Search ..... 313/581–587; 315/169.1, 169.3
See application file for complete search history.

(56) References Cited

U.S. PATENT DOCUMENTS 6,236,159 B1 5/2001 Inoue et al.
6,515,419 B1 * 2/2003 Lee et al. ..... 313/582
6,548,962 B1 * 4/2003 Shiokawa et al. ..... 315/169.4
6,707,259 B2 * 3/2004 Nagao et al. ..... 315/169.4
6,777,873 B2 * 8/2004 Hashikawa ..... 313/582
2003/0090212 A1 * 5/2003 Park et al. ..... 315/169.1
2003/0146713 A1 8/2003 Nagao et al.
2003/0197469 A1 * 10/2003 Kang et al. ..... 313/586
2003/0209982 A1 * 11/2003 Kim et al. ..... 313/584
2004/0051456 A1 * 3/2004 Kim ..... 313/582

FOREIGN PATENT DOCUMENTS

EP 1 313 124 5/2003
EP 1 398 814 3/2004
EP 1 434 190 6/2004
JP 09-129137 5/1997

OTHER PUBLICATIONS

European Search Report dated May 11, 2009.

* cited by examiner

*Primary Examiner*—Sikha Roy
*Assistant Examiner*—Tracie Y Green
(74) *Attorney, Agent, or Firm*—KED & Associates, LLP

(57) ABSTRACT

A plasma display panel is provided. The plasma display panel has an electrode structure in which a second gap formed between electrode pairs in a discharge cell at a corner region of the panel is smaller than a gap formed between electrode pairs in a discharge cell at a more peripheral region of the panel. The plasma display panel may improve discharge capabilities, particularly in the more peripheral region of the panel, when a foreign substance is present on surfaces of the electrodes.

10 Claims, 6 Drawing Sheets

PLASMA DISPLAY PANEL HAVING VARYING DISTANCE BETWEEN ELECTRODE PAIRS

CROSS-REFERENCES TO RELATED APPLICATIONS

This Nonprovisional application claims priority under 35 U.S.C. §119(a) on Patent Application No. 10-2005-0009282 filed in Korea on Feb. 1, 2005 the entire contents of which are hereby incorporated by reference.

BACKGROUND OF THE INVENTION

1. Field of the Invention

The present invention relates to a plasma display panel.

2. Background of the Related Art

A variety of flat display apparatuses, that have reduced the apparatus weight and volume, i.e., the disadvantages of a cathode ray tube, have been developed. These flat display apparatuses include a Liquid Crystal Display (LCD), a plasma display panel, a Field Emission Display (FED), Electro-Luminescence (EL) and the like. The plasma display panel is a display device that employs a gas discharge method, and can be easily manufactured in a large size and can display images of high luminance.

FIG. 1 is a plan view illustrating a plasma display panel in the related art. FIG. 2 shows a discharge cell of the plasma display panel shown in FIG. 1.

Referring to FIGS. 1 and 2, the discharge cell of the plasma display panel includes an address electrode 12X formed on a lower substrate 18, and a sustain electrode pair formed on an upper substrate 10, i.e., a scan electrode 12Y and a sustain electrode 12Z.

On the lower substrate 18 having formed the address electrode 12X thereon is formed a lower dielectric layer 22 for accumulating wall charges thereon. Barrier ribs 24 are formed on the lower dielectric layer 22. Phosphor 20 is coated on the surfaces of the lower dielectric layer 22 and the barrier ribs 24.

The barrier ribs 24 function to prevent ultraviolet rays generated by a discharge and a visible ray from leaking to neighboring discharge cells. The phosphor 20 is excited with ultraviolet rays generated by a gas discharge and generates any one visible ray of red, green or blue. An inert gas for gas discharge is injected into a discharge space formed by the upper substrate 10, the lower substrate 18 and the barrier ribs 24.

Each of the scan electrode 12Y and the sustain electrode 12Z formed on the upper substrate 10 has a transparent electrode 12*a* and a bus electrode 12*b*, and intersects the address electrode 12X.

Each of the transparent electrodes 12*a* is formed of a transparent conductive material to allow light supplied from the discharge cell to pass through. A bus electrode 12*b* is formed of a metal material having a low resistance.

An upper dielectric layer 14 and a protection film 16 are sequentially formed on the upper substrate 10 on which the scan electrode 12Y and the sustain electrode 12Z are formed. Wall charges generated during a discharge are accumulated on the upper dielectric layer 14.

The protection film 16 functions to prevent damage to the upper dielectric layer 14 due to sputtering generated during the discharge of plasma and also to enhance emission efficiency of secondary electrons. The protection film 16 is generally formed using Magnesium Oxide (MgO).

In the related art plasma display panel, after a discharge cell is selected by a counter discharge between the address electrode 12X and the scan electrode 12Y, a discharge is sustained by a surface discharge between the scan electrode 12Y and the sustain electrode 12Z. The phosphor 20 radiates a visible ray with ultraviolet rays generated when the discharge is sustained in the discharge cell. Gray levels can be implemented by controlling a period where a discharge is sustained in the discharge cell.

In the related art, however, there is a problem where a discharge is not generated even though a driving voltage is applied to discharge cells located in corner regions of the plasma display panel. That is, in an exhaust process of exhausting air and/or impurities (e.g., particles of MgO) within the discharge space toward the outside, or an injection process of injecting an inert gas, a foreign substance is adhered on the surfaces of the scan electrode 12Y and the sustain electrode 12Z of the discharge cell. A foreign substance remaining on the surfaces of the scan electrode 12Y and the sustain electrode 12Z hinders a plasma discharge. As a result, the foreign substance causes a problem in that a discharge is not generated even though a driving voltage is applied to a discharge cell.

SUMMARY OF THE INVENTION

Accordingly, an object of the present invention is to solve at least the problems and disadvantages of the background art.

It is an object of the present invention to provide a plasma display panel that can prevent a phenomenon in which a discharge is not generated due to impurities.

A plasma display panel according to an aspect of the present invention comprises a substrate comprising a first region and a second region, and a plurality of scan electrode and sustain electrode pairs formed on the first region and on the second region, wherein a first gap between a scan electrode and a sustain electrode of a pair on the first region is different from a second gap between a scan electrode and a sustain electrode of a pair on the second region.

A plasma display panel according to another aspect of the present invention comprises a substrate comprising a first region and a second region, and a plurality of scan electrode and a sustain electrode pairs on the first region and on the second region, wherein a first gap between a scan electrode and a sustain electrode of a pair on the first region is different from a second gap between a scan electrode and a sustain electrode of a pair on the second region, and at least one of a gas inlet and a gas outlet is disposed in the second region.

The first region and the second region may be located between a center of the substrate and a sealing material formed on the substrate. The first gap formed on the first region may be wider than the second gap formed on the second region.

The scan electrode on the first region and the second region may be a scan bus electrode. The sustain electrode on the first region and the second region may be a sustain bus electrode.

The scan electrode on the first region and the second region may be a scan transparent electrode. The sustain electrode on the first region and the second region may be a sustain transparent electrode.

The difference of the first gap and the second gap may be 2 μm or more to 5 μm or less.

The first gap may be 60 μm or more to 65 μm or less. The second gap may be 55 μm or more to 63 μm or less.

The difference between the first gap and the second gap may be 2 μm or more to 5 μm or less.

The first gap may be 60 μm or more to 65 μm or less. The second gap may be 55 μm or more to 63 μm or less.

A region between the sealing material and the center of the substrate may comprise one or more corner regions. The second region may be at least one of the one or more corner regions.

The corner region comprised of the second region may comprise 5 horizontal pixels by 5 vertical pixels from a vertex of the corner.

At least one of the gas inlet and the gas outlet may be disposed in the corner region comprising 5 horizontal pixels by 5 vertical pixels from the vertex.

As described above, in the plasma display panel according to the present invention, inter-electrode gaps of discharge cells on which impurities remain, of discharge cells formed on a display region on which images are displayed, are formed to be different from one another. Therefore, there is an advantage in that a phenomenon in which a discharge is not generated even if a driving voltage is applied is prevented.

BRIEF DESCRIPTION OF THE DRAWINGS

The invention will be described in detail with reference to the following drawings in which like numerals refer to like elements.

DETAILED DESCRIPTION OF THE PREFERRED EMBODIMENT

Figure 1:
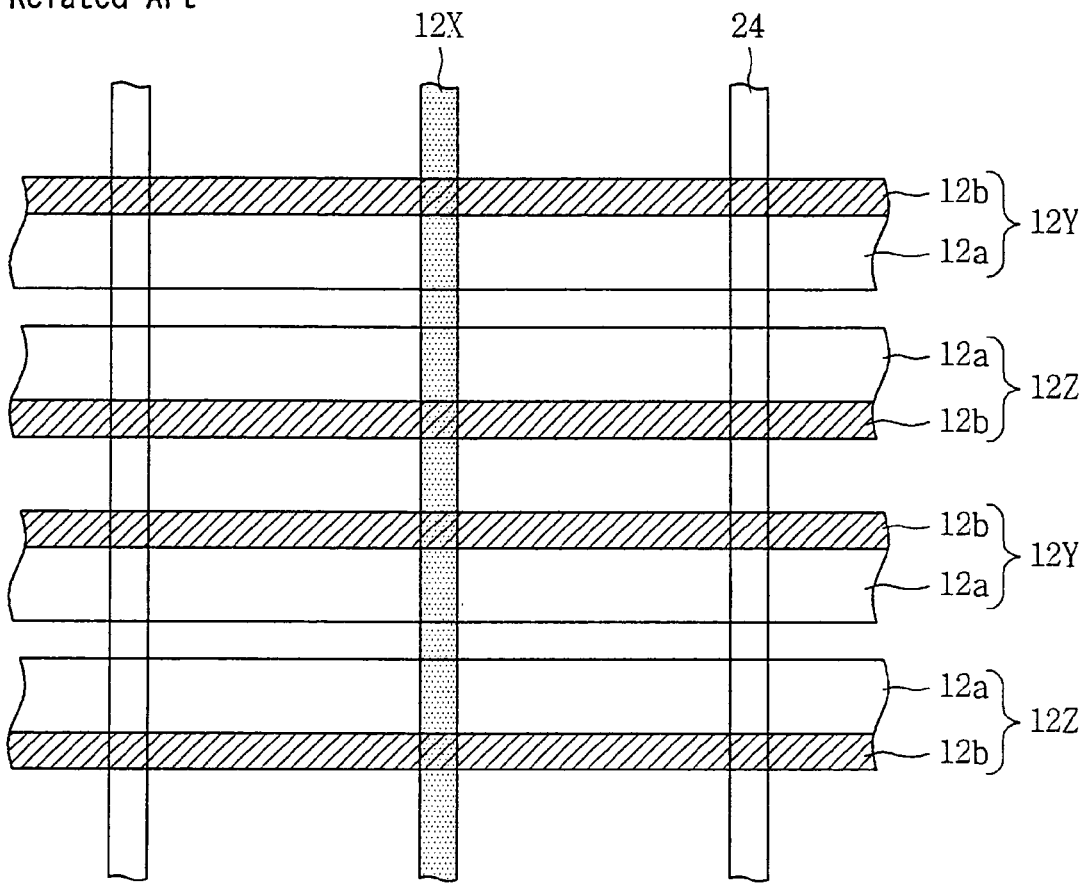
Fig. 1 Related Art
FIG. 1 is a plan view illustrating a plasma display panel in the related art.
Figure 2:
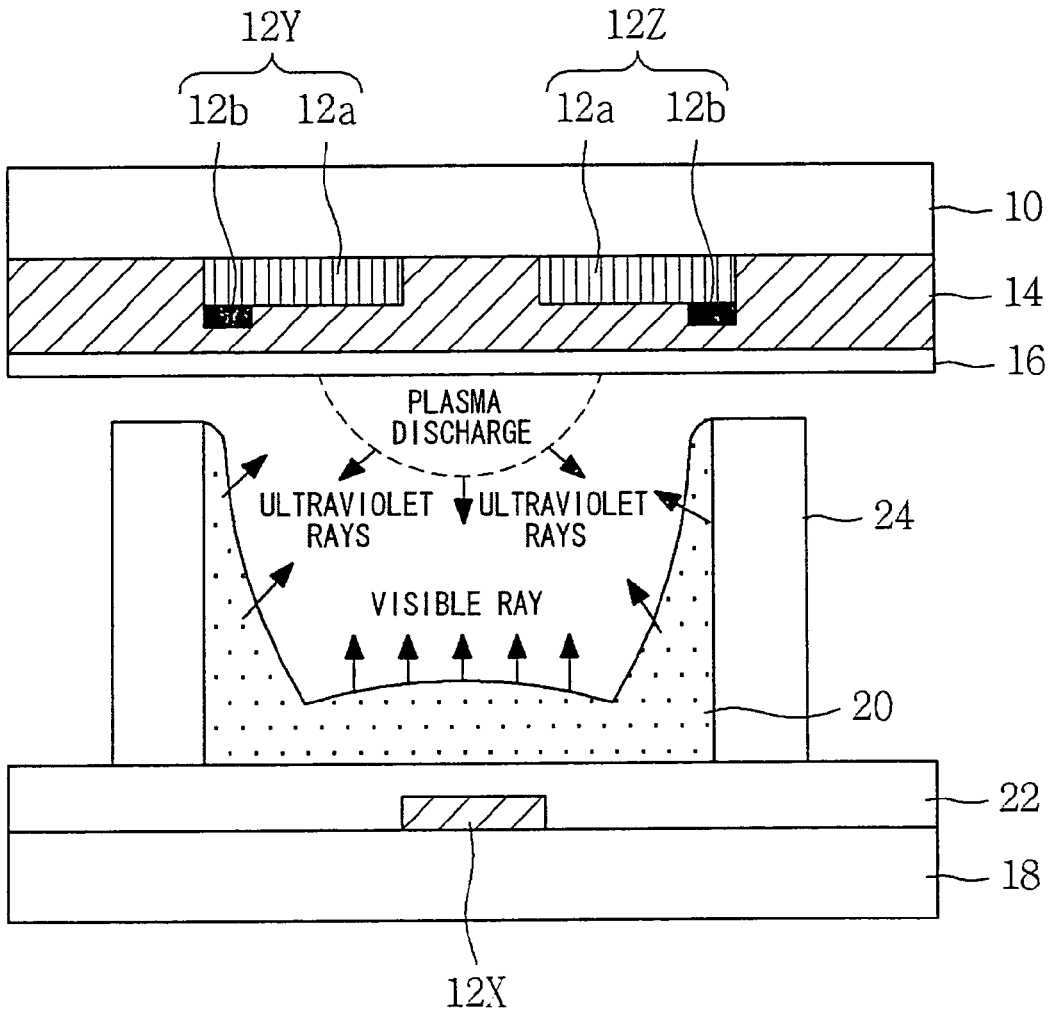
FIG. 2 shows a discharge cell of the plasma display panel shown in FIG. 1.

Preferred embodiments of the present invention will be described in a more detailed manner with reference to the drawings.

A plasma display panel according to an aspect of the present invention comprises a substrate comprising a first region and a second region, and a plurality of scan electrode and sustain electrode pairs formed on the first region and on the second region, wherein a first gap between a scan electrode and a sustain electrode of a pair on the first region is different from a second gap between a scan electrode and a sustain electrode of a pair on the second region.

The first region and the second region may be located between a center of the substrate and a sealing material formed on the substrate. The first gap formed on the first region may be wider than the second gap formed on the second region.

The scan electrode on the first region and the second region may be a scan bus electrode. The sustain electrode on the first region and the second region may be a sustain bus electrode.

The scan electrode on the first region and the second region may be a scan transparent electrode. The sustain electrode on the first region and the second region may be a sustain transparent electrode.

The difference of the first gap and the second gap may be 2 μm or more to 5 μm or less.

The first gap may be 60 μm or more to 65 μm or less. The second gap may be 55 μm or more to 63 μm or less.

The difference between the first gap and the second gap may be 2 μm or more to 5 μm or less.

The first gap may be 60 μm or more to 65 μm or less. The second gap may be 55 μm or more to 63 μm or less.

A region between the sealing material and the center of the substrate may comprise one or more corner regions. The second region may be at least one of the one or more corner regions.

The corner region comprised of the second region may comprise 5 horizontal pixels by 5 vertical pixels from a vertex of the corner.

A plasma display panel according to another aspect of the present invention comprises a substrate comprising a first region and a second region, and a plurality of scan electrode and a sustain electrode pairs on the first region and on the second region, wherein a first gap between a scan electrode and a sustain electrode of a pair on the first region is different from a second gap between a scan electrode and a sustain electrode of a pair on the second region, and at least one of a gas inlet and a gas outlet is disposed in the second region.

The first region and the second region may be located between a center of the substrate and a sealing material formed on the substrate. The first gap formed on the first region may be wider than the second gap formed on the second region.

The scan electrode and the sustain electrode on the first region and the second region may be a bus electrode.

The scan electrode and the sustain electrode on the first region and the second region may be a transparent electrode.

The difference of the first gap and the second gap may be 2 μm or more to 5 μm or less.

The first gap may be 60 μm or more to 65 μm or less, and the second gap may be 55 μm or more to 63 μm or less.

The difference of the first gap and the second gap may be 2 μm or more to 5 μm or less.

The first gap may be 60 μm or more to 65 μm or less, and the second gap may be 55 μm or more to 63 μm or less.

A region between the sealing material and the center of the substrate may comprise one or more corner regions. The second region is at least one of the one or more corner regions.

The corner region comprised of the second region may comprise 5 horizontal pixels by 5 vertical pixels from a vertex of the corner.

At least one of the gas inlet and the gas outlet may be disposed in the corner region comprising 5 horizontal pixels by 5 vertical pixels from the vertex.

Detailed embodiments of the present invention will now be described with reference to the accompanying drawings.

Figure 3:
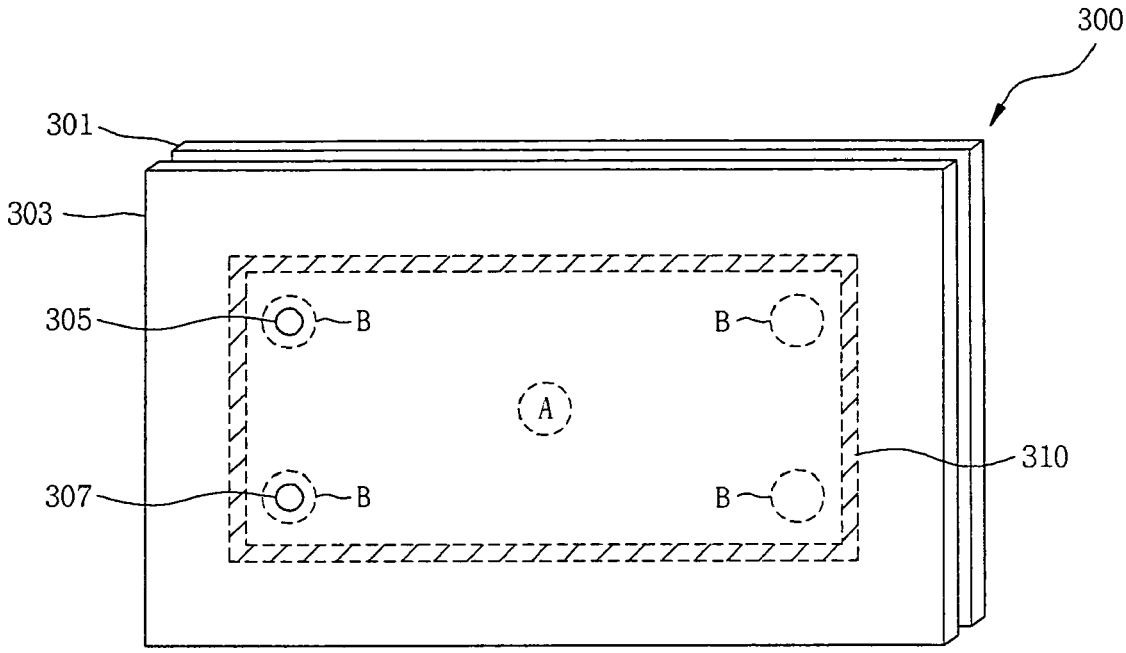
FIG. 3 shows a plasma display panel according to first and second embodiments of the present invention.

FIG. 3 shows a plasma display panel according to first and second embodiments of the present invention. As shown in FIG. 3, the plasma display panel according to first and second embodiments of the present invention comprises a sealant 310 for coalescing a front substrate 301 and a rear substrate 303 of a plasma display panel 300. After the front substrate 301 and the rear substrate 303 are coalesced, air and/or impurities existing in the discharge space formed between the upper substrate 301 and the lower substrate 303 are exhausted. An inert gas for a discharge is injected into the discharge space.

An outlet 305 for exhausting the air and/or impurities existing in the discharge space, and an inlet 307 for injecting the inert gas are formed in the rear substrate 303. The outlet 305 or the inlet 307 is formed in one or more second regions located between the center of the plasma display-panel according to first and second embodiments of the present invention and the sealant 310. In the first and second embodiments of the present invention, one or more second regions comprise one or more corner regions (B) between the center of the plasma display panel 300 and the sealant 310. The outlet 305 and the inlet 307 can be formed in one corner region (B) at the same time. If the outlet 305 is formed in one corner region (B), the inlet 307 can be formed in the other corner region (B).

In the case where dummy cells exist around the sealant 310, the corner regions (B) may not be included in a region where the dummy cells are formed.

An inter-electrode gap formed by a scan electrode and sustain electrode pair formed in the second regions (B) where the outlet 305 or the inlet 307 is formed, and an inter-electrode gap formed by a scan electrode and sustain electrode pair formed in a first region (A) where the outlet 305 or the inlet 307 is not formed are different from each other. This will be described with reference to FIGS. 4 and 5.

Embodiment 1

Figure 4:
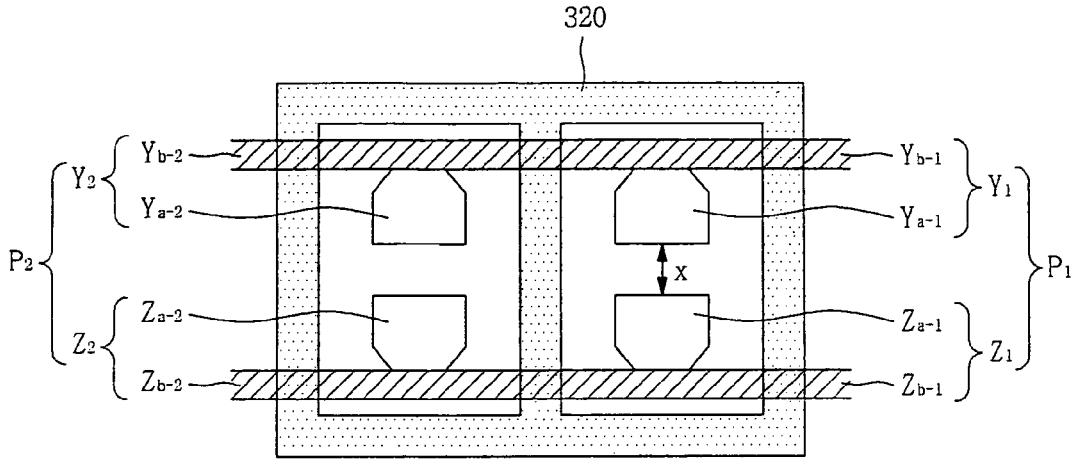
FIGS. 4 and 5 show the structure of electrodes formed in the plasma display panel according to the first embodiment of the present invention.
Figure 5:
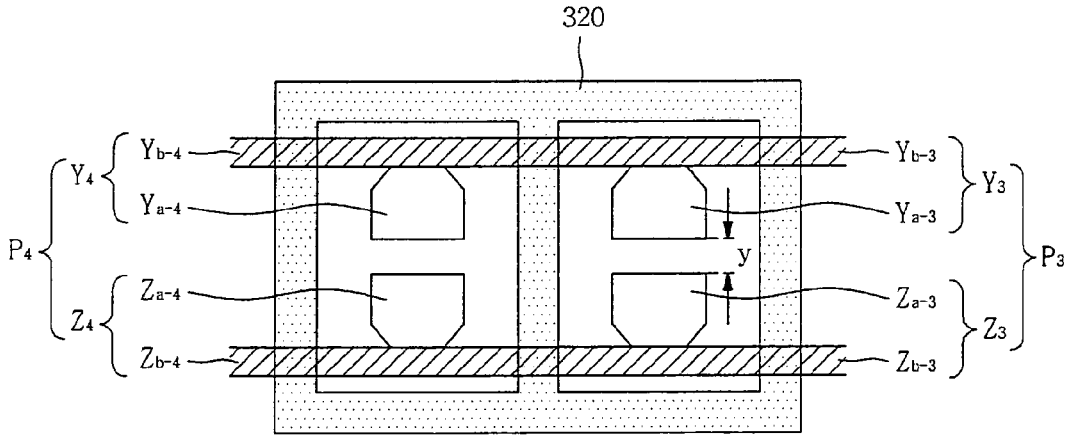

FIGS. 4 and 5 show the structure of electrodes formed in the plasma display panel according to the first embodiment of the present invention. FIG. 4 show the structure of electrodes formed in the first region of the plasma display panel according to the first embodiment of the present invention. FIG. 5 show the structure of electrodes formed in the second region of the plasma display panel according to the first embodiment of the present invention.

As shown in FIGS. 4 and 5, a plurality of scan electrode and sustain electrode pairs (P1, P2, P3 and P4) to which a driving voltage for generating a discharge is applied are formed in the first and second regions of plasma display panel according to the first embodiment of the present invention. Each of the scan electrode and sustain electrode pairs (P1, P2, P3 and P4) comprises transparent electrodes Ya-1, Ya-2, Ya-3, Ya-4, Za-1, Za-2, Za-3, Za-4 and bus electrodes Yb-1, Yb-2, Yb-3, Yb-4, Zb-1, Zb-2, Zb-3, Zb-4.

As shown in FIGS. 4 and 5, a first gap (x) formed by each of the scan electrode and sustain electrode pairs (P1, P2) formed in the first region (A) of FIG. 3 is larger than a second gap (y) formed by each of the scan electrode and sustain electrode pairs (P3, P4) formed in the corner region (B) included in the second region of FIG. 3. That is, the first gap (x) formed by each of the scan transparent electrodes Ya-1, Ya-2 and each of the sustain transparent electrodes Za-1, Za-2 formed in the first region (A) of FIG. 3 is larger than the second gap (y) formed by each of the scan transparent electrodes Ya-3, Ya-4 and each of the sustain transparent electrodes Za-3, Za-4 formed in the corner region (B) included in the second region of FIG. 3.

The second gap (y) can be formed to be 2 μm to 5 μm smaller than the first gap (x). Furthermore, the first gap (x) can range from 60 μm to 65 μm and the second gap (y) can range from 55 μm to 63 μm.

The second gap (y) between the scan electrode and the sustain electrode formed in the corner region (B) of the second region is smaller than the first gap (x) between the scan electrode and the sustain electrode formed in the first region (A). Therefore, a phenomenon in which a discharge is not generated is prevented even if a foreign substance is adhered on the surfaces of the scan electrode and the sustain electrode formed in the corner region (B).

In FIGS. 4 and 5, reference numeral 320 designates a barrier rib.

Embodiment 2

Figure 6:
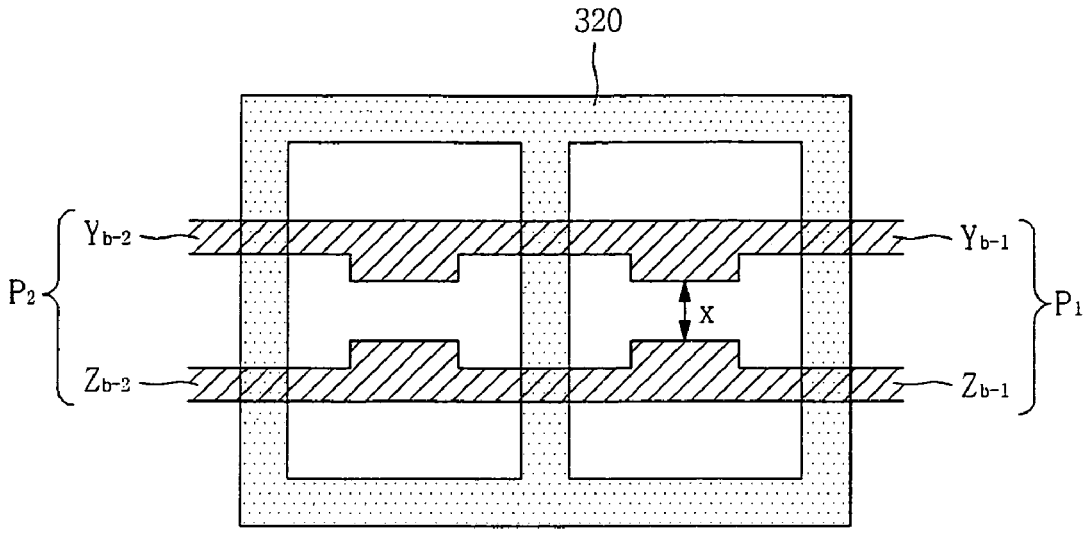
FIGS. 6 and 7 show the structure of electrodes formed in the plasma display panel according to the second embodiment of the present invention.
Figure 7:
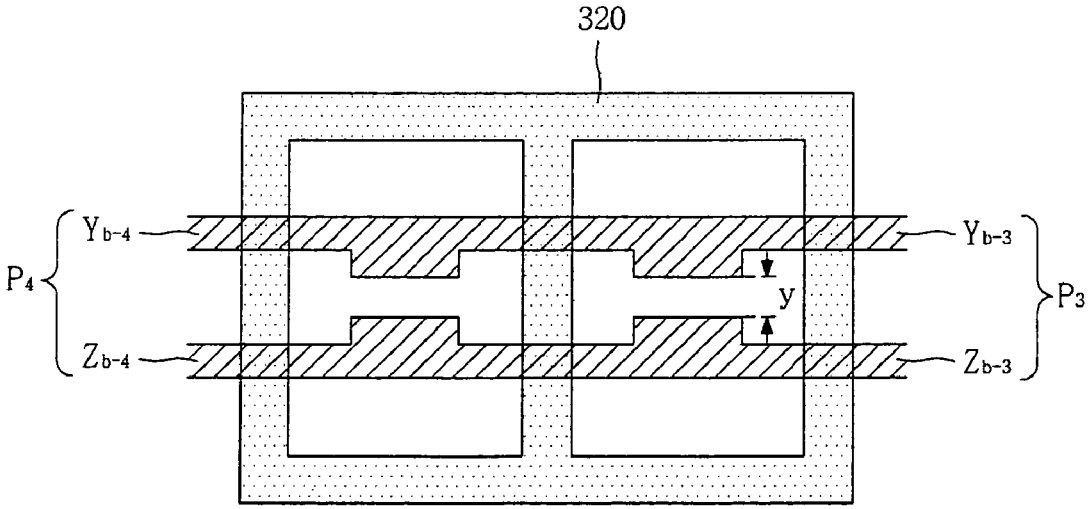

FIGS. 6 and 7 show the structure of electrodes formed in the plasma display panel according to the second embodiment of the present invention. FIG. 6 show the structure of electrodes formed in the first region of the plasma display panel according to the second embodiment of the present invention. FIG. 7 show the structure of electrodes formed in the second region of the plasma display panel according to the second embodiment of the present invention.

As shown in FIGS. 6 and 7, a plurality of scan electrode and sustain electrode pairs (P1, P2, P3 and P4) to which a driving voltage for generating a discharge is applied is formed in the first and second regions of the plasma display panel according to the second embodiment of the present invention. Each of the scan electrode and sustain electrode pairs (P1, P2, P3 and P4) comprises bus electrodes Yb-1, Yb-2, Yb-3, Yb-4, Zb-1, Zb-2, Zb-3, Zb-4.

As shown in FIGS. 6 and 7, a first gap (x) formed by each of the scan electrode and sustain electrode pairs (P1, P2) formed in the first region (A) of FIG. 3 is larger than a second gap (y) formed by each of the scan electrode and sustain electrode pairs (P3, P4) formed in the corner region (B) included in the second region of FIG. 3. That is, the first gap (x) formed by each of the scan bus electrodes Yb-1, Yb-2 and each of the sustain bus electrodes Zb-1, Zb-2 formed in the first region (A) of FIG. 3 is larger than the second gap (y) formed by each of the scan bus electrodes Yb-3, Yb-4 and each of the sustain transparent electrodes Zb-3, Zb-4 formed in the corner region (B) included in the second region of FIG. 3.

The second gap (y) can be formed to be 2 μm to 5 μm smaller than the first gap (x). Furthermore, the first gap (x) can range from 60 μm to 65 μm and the second gap (y) can range from 55 μm to 63 μm.

The second gap (y) between the scan electrode and the sustain electrode formed in the corner region (B) of the second region is smaller than the first gap (x) between the scan electrode and the sustain electrode formed in the first region (A). Therefore, a phenomenon in which a discharge is not generated is prevented even if a foreign substance adheres on the surfaces of the scan electrode and the sustain electrode formed in the corner region (B).

In FIGS. 6 and 7, reference numeral 320 designates a barrier rib.

Figure 8:
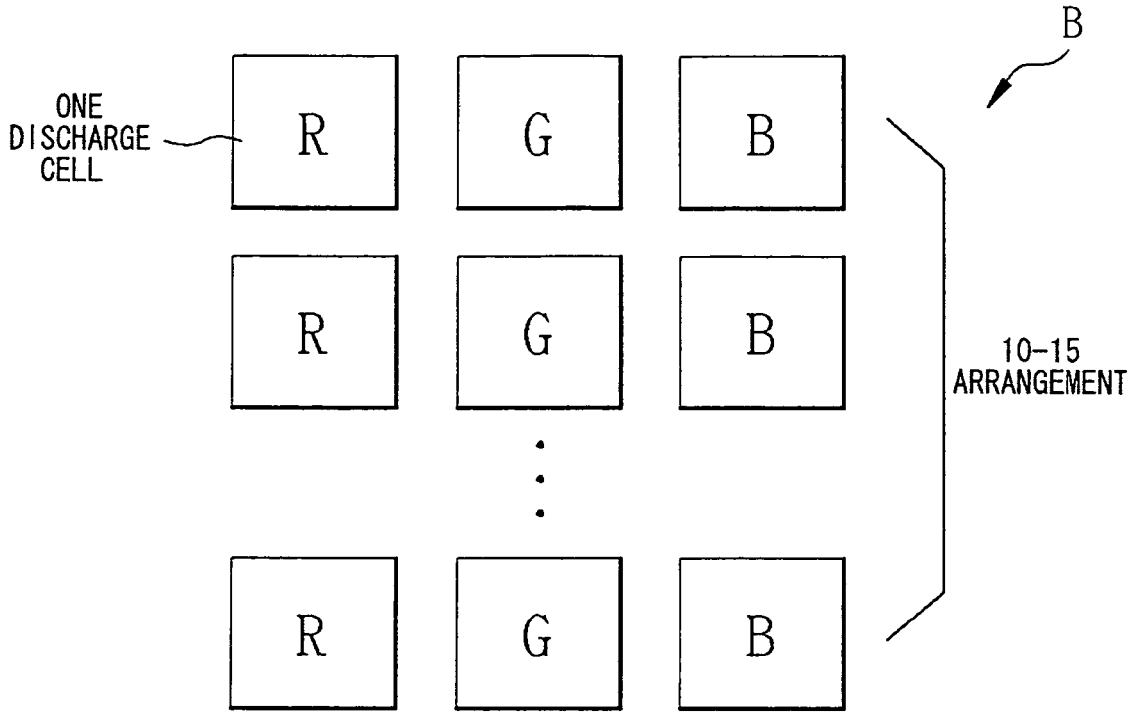
FIG. 8 illustrates discharge cells formed on the corner region according to the first and second embodiments of the present invention.

FIG. 8 illustrates discharge cells formed on the corner region according to the first and second embodiments of the present invention. Referring to FIG. 8, the corner region (B) in which scan electrodes and sustain electrodes forming the second gap (y) smaller than the first gap (x) are formed can correspond to thirty to fifty five discharge cells.

That is, there is a high possibility that the three discharge cells from the left or right end on the corner region (B) and ten or fifteen discharge cells from the top or bottom on the corner region (B) may not be turned on.

The embodiment of the invention being thus described may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel, comprising:

a pair of substrates facing each other with a space formed therebetween;

a plurality of barrier ribs that partition the space formed between the pair of substrates into a plurality of discharge cells;

a pair of electrodes comprising a scan electrode and a sustain electrode provided in each of the plurality of discharge cells, wherein the pair of substrates comprises a first region provided at a center portion of the space formed between the pair of substrates, and a second region provided at an inner corner defined by a sealing material provided near a peripheral portion of the space formed between the pair of substrates, wherein a first gap formed between the scan electrode and the sustain electrode of a corresponding discharge cell in the first region is greater than a second gap formed between the scan electrode and the sustain electrode of a corresponding discharge cell in the second region, wherein the second gap enhances a discharge between the scan electrode and the sustain electrode in the second region; and at least one of a gas inlet or a gas outlet provided in the second region.

2. The plasma display panel of claim 1, wherein the scan electrode on the first region and the second region is a scan bus electrode, and the sustain electrode on the first region and the second region is a sustain bus electrode.

3. The plasma display panel of claim 1, wherein the scan electrode on the first region and the second region is a scan transparent electrode, and the sustain electrode on the first region and the second region is a sustain transparent electrode.

4. The plasma display panel of claim 1, wherein a difference between the first gap and the second gap is greater than or equal to 2 μm and less than or equal to 5 μm.

5. The plasma display panel of claim 1, wherein the first gap is greater than or equal to 60 μm and less than or equal to 65 μm, and the second gap is greater than or equal to 55 μm and less than or equal to 63 μm.

6. The plasma display panel of claim 3, wherein a difference between the first gap and the second gap is greater than or equal to 2 μm and less than or equal to 5 μm.

7. The plasma display panel of claim 3, wherein the first gap is greater than or equal to 60 μm and less than or equal to 65 μm, and the second gap is greater than or equal to 55 μm and less than or equal to 63 μm.

8. The plasma display panel of claim 1, wherein a region between the sealing material and the center portion of the substrate comprises a plurality of corner regions defined by the sealing material, wherein the second region is located at least one of the plurality of corner regions.

9. The plasma display panel of claim 8, wherein each of the plurality of corner regions of the second region comprises 5 horizontal pixels by 5 vertical pixels from a vertex of a respective corner region.

10. The plasma display panel of claim 1, wherein the first gap is formed only between a scan electrode and a sustain electrode pair provided on the first region of the substrate, and the second gap is formed only between a scan electrode and a sustain electrode pair provided on the second region of the substrate.

* * * * *